US007342551B2

(12) United States Patent
King

(10) Patent No.: US 7,342,551 B2
(45) Date of Patent: Mar. 11, 2008

(54) ANTENNA SYSTEMS FOR RELIABLE SATELLITE TELEVISION RECEPTION IN MOISTURE CONDITIONS

(75) Inventor: Lael D. King, Minneapolis, MN (US)

(73) Assignee: Electronic Controlled Systems, Bloomington, MN (US)

( * ) Notice: Subject to any disclaimer, the term of this patent is extended or adjusted under 35 U.S.C. 154(b) by 0 days.

(21) Appl. No.: 10/952,564

(22) Filed: Sep. 28, 2004

(65) Prior Publication Data

US 2005/0225495 A1 Oct. 13, 2005

Related U.S. Application Data

(60) Provisional application No. 60/561,795, filed on Apr. 13, 2004.

(51) Int. Cl.
*H01Q 1/42* (2006.01)

(52) U.S. Cl. ..... 343/786; 343/840; 343/872; 343/912

(58) Field of Classification Search ..... 343/840, 343/872, 912, 786, 873; 427/213.31
See application file for complete search history.

(56) References Cited

U.S. PATENT DOCUMENTS 3,388,401 A 6/1968 Weir
3,781,898 A 12/1973 Holloway
4,282,530 A 8/1981 Semplak
4,804,972 A 2/1989 Schudel
4,918,459 A 4/1990 De Teso
4,946,736 A 8/1990 Sassa
5,357,726 A 10/1994 Effenberger et al.
5,368,924 A 11/1994 Merrill, Jr. et al.
5,398,035 A * 3/1995 Densmore et al. ..... 343/713
5,451,972 A 9/1995 Franklin
5,528,253 A 6/1996 Franklin
5,675,348 A 10/1997 Okada et al.
5,729,241 A 3/1998 Ergen et al.
5,815,125 A 9/1998 Kelly et al.

(Continued)

OTHER PUBLICATIONS

"Measurements of 20-Ghz Transmission Through a Radome in Rain," IEEE Transactions on Antennas and Propagation, vol. AP-23, No. 5, Sep. 1975.

(Continued)

*Primary Examiner*—Michael C. Wimer
(74) *Attorney, Agent, or Firm*—Patterson, Thuente, Skaar & Christensen, P.A.

(57) ABSTRACT

More reliable satellite television reception in moisture conditions is provided by recognizing the critical relationship between satellite signal transmissivity and the effects of superhydrophobocity. Instead of trying to use a hydrophobic or superhydrophobic coating or material to shed water from a satellite antenna, superhydrophobic materials and coatings are strategically utilized to minimize the impact of water on the transmissivity of the satellite signal through transmissive surfaces in the antenna system. In a preferred embodiment, an exterior surface of a feed horn cover is coated with a superhydrophobic material to maintain a more consistent satellite signal reception. In an alternate embodiment, an exterior surface of a dome covering a small dish DBS satellite television antenna system is coated with a superhydrophobic material to minimize the overall satellite signal loss during moisture conditions so as to permit a dome to be effectively used over a small dish DBS satellite television antenna system.

24 Claims, 9 Drawing Sheets

U.S. PATENT DOCUMENTS

| | | | | |
|---|---|---|---|---|
| 5,877,730 | A | 3/1999 | Foster | |
| 6,072,440 | A | 6/2000 | Bowman | |
| 6,156,389 | A | 12/2000 | Brown et al. | |
| 6,191,753 | B1 | 2/2001 | Ellis et al. | |
| 6,292,155 | B1 | 9/2001 | McPhilmy et al. | |
| 6,447,919 | B1 | 9/2002 | Brown | |
| 6,495,624 | B1 | 12/2002 | Brown | |
| 6,538,612 | B1 | 3/2003 | King | |
| 6,649,222 | B1 * | 11/2003 | D'Agostino et al. | 427/490 |
| 6,663,941 | B2 | 12/2003 | Brown et al. | |
| 6,683,126 | B2 | 1/2004 | Keller et al. | |
| 6,714,167 | B1 | 3/2004 | Gusick, Jr. | |
| 6,767,587 | B1 | 7/2004 | Brown | |
| 2003/0017349 | A1 | 1/2003 | Brown et al. | |
| 2004/0082699 | A1 | 4/2004 | Brown | |
| 2004/0131789 | A1 | 7/2004 | Brown | |
| 2005/0003203 | A1 | 1/2005 | Brown | |

OTHER PUBLICATIONS

"Superhydrophobic PTFE Surfaces by Extension," Macromolecular Rapid Communications, vol. 25, pp. 1105-1108 (2004).

"Transformation of a Simple Plastic into a Superhydrophobic Surface," Science, vol. 299, 1377-1379, Feb. 28, 2004.

* cited by examiner

Fig. 5a

UNCOVERED ANTENNA TESTING

| | | | SIGNAL START | SIGNAL FINAL |
|---|---|---|---|---|
| CASE 1 | UNTREATED | WATER ON LNB | 83 | 0 |
| | | WATER ON DISH | 83 | 66 |
| | | WATER BETWEEN | 83 | 62 |
| | | WATER ON ALL | 83 | 0 |
| CASE 2 | DISH TREATED ONLY | WATER ON LNB | 83 | 0 |
| | | WATER ON DISH | 83 | 66-70 |
| | | WATER BETWEEN | 83 | 66 |
| | | WATER ON ALL | 83 | 0 |
| CASE 3 | LNB TREATED ONLY | WATER ON LNB | 83 | 61-66 |
| | | WATER ON DISH | 83 | 66 |
| | | WATER BETWEEN | 83 | 64 |
| | | WATER ON ALL | 83 | 60 |
| CASE 4 | DISH AND LNB TREATED | WATER ON LNB | 83 | 62-66 |
| | | WATER ON DISH | 83 | 68-70 |
| | | WATER BETWEEN | 83 | 67-69 |
| | | WATER ON ALL | 83 | 60-65 |

Fig. 5b

SHIELDED ANTENNA TESTING

| | | | SIGNAL START | SIGNAL | FINAL |
|---|---|---|---|---|---|
| CASE 5 | TREATED SHIELD ONLY | WATER ON DOME | 95 | 50 | |
| CASE 6 | UNTREATED SHIELD | WATER ON DOME | 95 | 0 | |

Fig. 5c

DOME ANTENNA TESTING

| | | | SIGNAL START | SIGNAL | FINAL |
|---|---|---|---|---|---|
| CASE 7 | TREATED DOME | WATER ON DOME | 74 | 51 | |
| CASE 8 | UNTREATED DOME | WATER ON DOME | 74 | 0 | |

Fig. 8

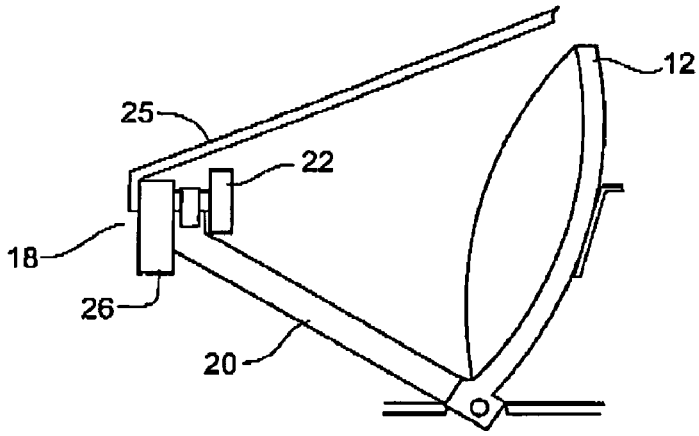

Fig. 9

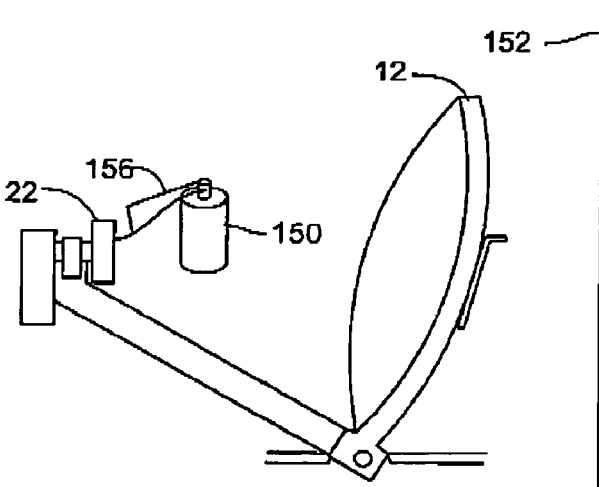

Directions for use

1. Apply when air temperature is between 60° and 110°.
2. Clean surface with warm soapy water to remove dirt, dust and other debris.
3. Thoroughly dry surface.
4. Shake can vigorously for 10 seconds.
5. Hold can upright and spray with a slow sweeping circular motion, 6 - 12 inches from surface until evenly coated and appearing wet. Allow 20 minutes to dry. Apply second coat after drying for greater performance.
6. Reapply after each cleaning.

ANTENNA SYSTEMS FOR RELIABLE SATELLITE TELEVISION RECEPTION IN MOISTURE CONDITIONS

PRIORITY CLAIM

The current application claims the benefit of priority from U.S. Provisional Patent Application No. 60/561,795 filed on Apr. 13, 2004, entitled "HYDROPHOBIC SATELLITE ANTENNA SYSTEM," which is hereby incorporated by reference herein.

FIELD OF THE INVENTION

The present invention relates generally to microwave antennas and receivers having protection or prevention systems for rain or ice. More particularly, the present invention relates to systems for creating more reliable satellite television reception in conditions where moisture, such as rain, snow, ice or dew, would otherwise interfere with satellite television reception.

BACKGROUND OF THE INVENTION

Satellite transmissions for commercial television are broadcast from satellites in geosynchronous orbits to satellite antenna systems designed to receive signals in the 5-30 GHz range. For example, Direct Broadcast Satellite (DBS) transmissions are delivered at the 11-to-15 GHz frequency range, known as the Ku-band, to dish-shaped antennas. While antennas for receiving satellite television signals can measure up to sixty inches or more in diameter, current satellite dish antenna designs are generally less than thirty-six inches in diameter. The most common DBS satellite television dish antennas are only about eighteen inches in diameter (e.g., DirecTV®, Dish Network (Echostar), Bell Express View).

The antenna dish concentrates and reflects satellite microwave signals that strike the antenna dish back to a focal point that is in front of the antenna dish. A feed horn is positioned on a support arm at the focal point to route the microwave signals to a signal converter that converts the microwave signals into electrical signals. These electrical signals are then provided to a satellite receiver that translates the electrical signals into a television picture and sound.

A long-standing and still unresolved problem with satellite reception is signal loss and signal fade caused by weather conditions, such as rain, ice, dew, wind or snow (hereinafter referred to as "rain fade"). As any viewer of a satellite television system can confirm, the presence of moisture interferes with and often totally blocks good satellite signal reception. Many attempts have been suggested over the years to improve satellite reception in the face of various weather conditions.

For larger antennas, the use of domes, radomes or other types of covers to protect the antenna has been a common approach to addressing this problem. Most domes or radomes for satellite dishes are hemispherical shells made of fiberglass or other similar materials that will interfere with the transmission of microwaves as little as possible. U.S. Pat. No. 4,804,972 describes a clamshell configuration for a hard radome. U.S. Pat. No. 4,946,736 describes laminated panels for use in a large radome made of porous expanded polytetraflouroethylene (Teflon®). U.S. Pat. Nos. 3,388,401, 4,918,459 and 5,451,972 describe examples of flexible fabric covers that cover just the dish for a larger antenna. U.S. Pat. No. 5,528,253 describes a flexible fabric cover that also extends over the support arm and feed horn.

In addition to the antenna, a plastic cover or protective shield has long been used for protecting the entry to the feed horn itself as shown, for example, in U.S. Pat. No. 3,781,898. There is a critical relationship between wavelength of the microwaves and the design of the feed horn cover that impacts the ability of the signal converter to convert the microwaves received at the feed horn into electrical signals. This electromagnetic relationship is described in U.S. Pat. No. 5,675,348, that teaches even the thickness of the feed horn cover can affect the signal strength provided to the signal converter. As a result of the desire to protect this critical relationship, approaches for protecting or covering the feed horn have focused on providing brims or hoods that serve as rain deflectors for the feed horn as shown, for example, in U.S. Pat. Nos. 4,282,530 and 6,072,440. Most of the attempts to address the problems of rain fade, however, have focused on covering or shielding the satellite dish or to the entire satellite system. Although these solutions can address the problem to a certain extent, none of these attempts have prevented the intermittent reception, and sometimes total loss of satellite television signal during adverse weather conditions.

While a radome or cover over the antenna dish necessarily reduces the overall satellite signal strength the antenna receives, a reduction in overall signal strength in exchange for a more consistent signal during weather conditions can be acceptable for larger antennas where the initial signal strength is sufficient to tolerate such a reduction. This is due in part to the squared relationship between the diameter of a dish antenna and the surface area of that dish antenna that serves to reflect and focus the incoming satellite signals back into the feed horn that is connected to the actual circuitry of the satellite receiver. An antenna dish with ½ the diameter will have only about ¼ of the surface area to collect and reflect the signal back into the feed horn.

Even though most newer dish designs for DBS satellite television systems have diameters that are only one-third the size of larger, older DBS antenna systems (and therefore collect only about one-ninth of the satellite signal energy), various domes, radomes and covers have been proposed to address the problems of weather and rain fade for these smaller DBS satellite antennas. U.S. Pat. Nos. 5,729,241 and 6,714,167 describe flexible covers for just the dish antenna of a DBS satellite television system. U.S. Pat. No. 5,815,125 describes a flexible cover for a DBS antenna system that covers both the antenna and the feed horn. U.S. Pat. No. 5,877,730 describes a hard brim extending out from the dish of a DBS satellite antenna. U.S. Pat. No. 6,538,612 describes a dome for a DBS satellite antenna for a mobile home that includes an automated satellite locator system to orient the dish antenna under the dome. U.S. Pat. No. 6,191,753 describes a hard cone-shaped cover for both dish and feed horn of a DBS satellite antenna. Not surprisingly, none of these arrangements has provided a satisfactory or viable solution to the problem of satellite rain fade.

Part of the reason for the failure of domes, radomes and covers to solve the problem of rain fade can be traced to the absorptive and reflective properties of water that builds up on the surface of the dome, radome or cover. These effects were first analyzed in experiments conducted more than thirty years ago. Anderson, "*Measurements of* 20-*Ghz Transmission Through a Radome in Rain*," IEEE Transactions on Antennas and Propagation, Vol. AP-23, No. 5, September 1975.

In recognition of these effects, almost every type of commercially available "water repellant" or "waterproof" coating has been suggested for use on domes, radomes, antennas and antenna covers as a way of shedding or repelling water in order to minimize these effects. For example, U.S. Pat. Nos. 5,357,726 and 5,368,924 describe improved waterproof fabrics for use as antenna covers. U.S. Pat. No. 6,292,155 even describes the use of hydrophobic tear-off protection sheets for a DBS satellite dish. While these kinds of water repellant or hydrophobic coatings or materials can provide some degree of improvement, none have been able to solve the problems of satellite signal rain fade, particularly for the newer, smaller DBS antenna dishes.

In the last few years, a new class of water repellant or hydrophobic materials known as superhydrophobic materials have been developed. Measurements for how water repellant a material will be utilize a measurement of the static contact angle between a drop of water and the surface of the material. For materials with a static contact angle of less than 90° generally form a sheet or film in response to heavy moisture. Most hydrophobic materials have a static contact angle of between about 90° and 120°. Heavy rain tends to form rivulets on the surface of a hydrophobic material allowing the water to run off as large drops or streams. Superhydrophobic materials have static contact angles greater than about 1200 and often greater than 140° to 150°. Heavy rain tends to roll off the surface of a superhydrophobic material as very small drops rather than slide off.

Examples of these kinds of superhydrophobic or extremely hydrophobic coatings are described in U.S. Pat. No. 6,663,941 describing flourothane superhydrophobic materials and U.S. Pat. No. 6,683,126 describing a nanoparticle powder dispersed in a binder that creates a superhydrophobic effect. Other examples of superhydrophobic materials include: Vellox™ LC-410 treated silica paint, Nanosil nanoscale surface texturing, treated isotactic polypropylene, a silica polystyrene film treated with flouroalkysilane, a poly(tetraflouroethylene) (PTFE) film where the density of crystals in the film are decreased by axial extension of the film, and a low percentage titanium oxide film.

Some of the descriptions of these various superhydrophobic materials suggest that they can be used in coating satellite dish antennas. Unfortunately, it has been discovered that coating the satellite antenna dish with a superhydrophobic material does not have a significant impact on the problem of rain fade, particularly for the smaller DBS satellite television antennas. Thus, there is a continuing, unmet need for a satellite antenna system that can create more reliable satellite television reception in conditions where moisture would otherwise interfere with satellite television reception.

SUMMARY OF THE INVENTION

The present invention is a system that provides for more reliable satellite television reception in moisture conditions by recognizing the critical relationship between satellite signal transmissivity and the effects of superhydrophobocity. Instead of trying to use a hydrophobic or superhydrophobic coating or material to shed water from a satellite antenna, the present invention utilizes superhydrophobic materials and coatings to minimize the impact of water on the transmissivity of the satellite signal through transmissive surfaces in the antenna system. In a preferred embodiment, the present invention coats an exterior surface of a feed horn cover with a superhydrophobic material to maintain a more consistent satellite signal reception. In an alternate embodiment, the present invention coats an exterior surface of a dome covering a small dish DBS satellite television antenna system with a superhydrophobic material to minimize the overall satellite signal loss during moisture conditions so as to permit a dome to be effectively used over a small dish DBS satellite television antenna system.

Instead of trying to shed water from a reflective surface of the antenna system such as the parabolic dish, the present invention utilizes the superhydrophobic effect on a transmissive surface, i.e., a surface that the satellite microwaves pass through instead of being reflected, deflected and/or absorbed by the surface. Transmissivity through a transmissive surface of the antenna system is maximized under moisture conditions by utilizing a superhydrophobic material to decrease the effective shadow created by water droplets on that surface. In essence, the present invention has discovered that the drops of water are not the problem, the problem is the electromagnetic shadows created by those drops of water. Because shadows are not created by the reflection of an electromagnetic wave, reducing the amount of water on a reflective surface has only a limited or insignificant effect on the overall performance of the satellite antenna.

For most uncovered small dish DBS satellite television antenna systems, the transmissive surface that has the largest impact on the reliability of satellite signal reception in moisture conditions is the feed horn cover. For a small dish DBS satellite television antenna system under a protective dome, the degradation of signal strength that occurs by virtue of the dome itself can be tolerated if moisture conditions on the dome do not exacerbate consistent satellite signal reception.

For superhydrophobic materials having a static contact angle ($\theta_c$) of about 120° or greater, the area of the effective shadow cast by a drop of water having a radius ($r_1$) can be approximated by the amount of wettable area or wetting area where there is contact between a drop of water and a surface such that:

$$\text{Effective shadow} = \pi r_1^2 (\text{Sin}\theta_c)^2.$$

Hydrophobic materials having static contact angles ($\theta_c$) of less than about 110° will cast an effective shadow of about 90% or more of the cross-sectional area of a drop of water. In contrast, superhydrophobic materials having a static contact angle ($\theta_c$) of about 130° or greater will cast an effective shadow of less than about 60% of the cross-sectional area of a drop of water.

For the uncovered small dish DBS satellite television system, the preferred embodiment of the present invention that treats the feed horn cover with a superhydrophobic material results in satellite signal reception under moisture conditions that is degraded by no more than about 33% from signal strengths in non-moisture conditions. Where the original signal strength was at least about 70 on most signal strength meter scales reading 0-100, this degree of decrease in signal strength does not result in a loss of satellite television picture. In contrast, an uncovered small dish DBS satellite television system in which the antenna dish was treated with a superhydrophobic material, but the feed horn cover was not treated resulted in satellite signal reception under moisture conditions that was degraded by a varying amount that can range to more than about 66% and even up to 100% loss as compared to signal strengths in non-moisture conditions. Signal strengths in the range of 20-40 on most signal strength meter scales (depending on transponder, receiver and the antenna system) will result in the pixilation or intermittent loss of the satellite television signal. Decreases in signal strength below this range will result in the entire loss of a satellite television picture.

For the alternate embodiment in which a dome for a small dish DBS satellite television system is treated with a superhydrophobic material, there is less than a 5-10% loss in signal strength in moisture conditions as compared to the signal strength through the dome in non-moisture conditions. When the 5-20% loss in signal caused by the dome itself is added to the overall signal strength profile, the overall signal loss in this embodiment is less than about 30% as compared to the signal strength in non-moisture conditions without the dome in place.

In a preferred embodiment, the superhydrophobic treatment of a transmissive surface is created by the use of a superhydrophobic composition of nanoparticles suspended in a binder solution. The nanoparticles create a rough surface at the molecular level so as to minimize the contact of the water molecules to the surface. Such a material is described in U.S. Pat. No. 6,683,126, assigned to BASF Aktiengesllschaft, which is incorporated by reference herein in its entirety.

In one embodiment pursuant to U.S. Pat. No. 6,683,126, the superhydrophobic material is comprised of a finely divided powder whose particles have a hydrophobic surface and a porous structure characterized by a BET surface area of at least 1 $m^2/g$, and at least one film forming binder characterized by a surface tension of 50 mN/m. The weight ratio of the hydrophobic powder to binder should be at least 1:4. Preferably, this mixture can be further diluted for spreadability by addition of an organic solvent. In one embodiment, a dilution ratio of 1:12 ratio with an aromatic hydrocarbon solvent provided excellent coverage of the transmissive surfaces with consistent reception.

BRIEF DESCRIPTION OF THE DRAWINGS

FIGS. 5*a*, 5*b* and 5*c* illustrate transmissivity results comparing the effectiveness of the techniques of three alternate embodiments of the present invention to the effectiveness of the techniques of the prior art.

FIG. 8 is a cutaway perspective view of a small dish DBS satellite antenna system under a transmissive structure for a ground mount application.

FIG. 9 is a perspective view of an application sequence for applying a superhydrophobic material to a feed horn.

DETAILED DESCRIPTION OF THE PREFERRED EMBODIMENTS

Figure 1:
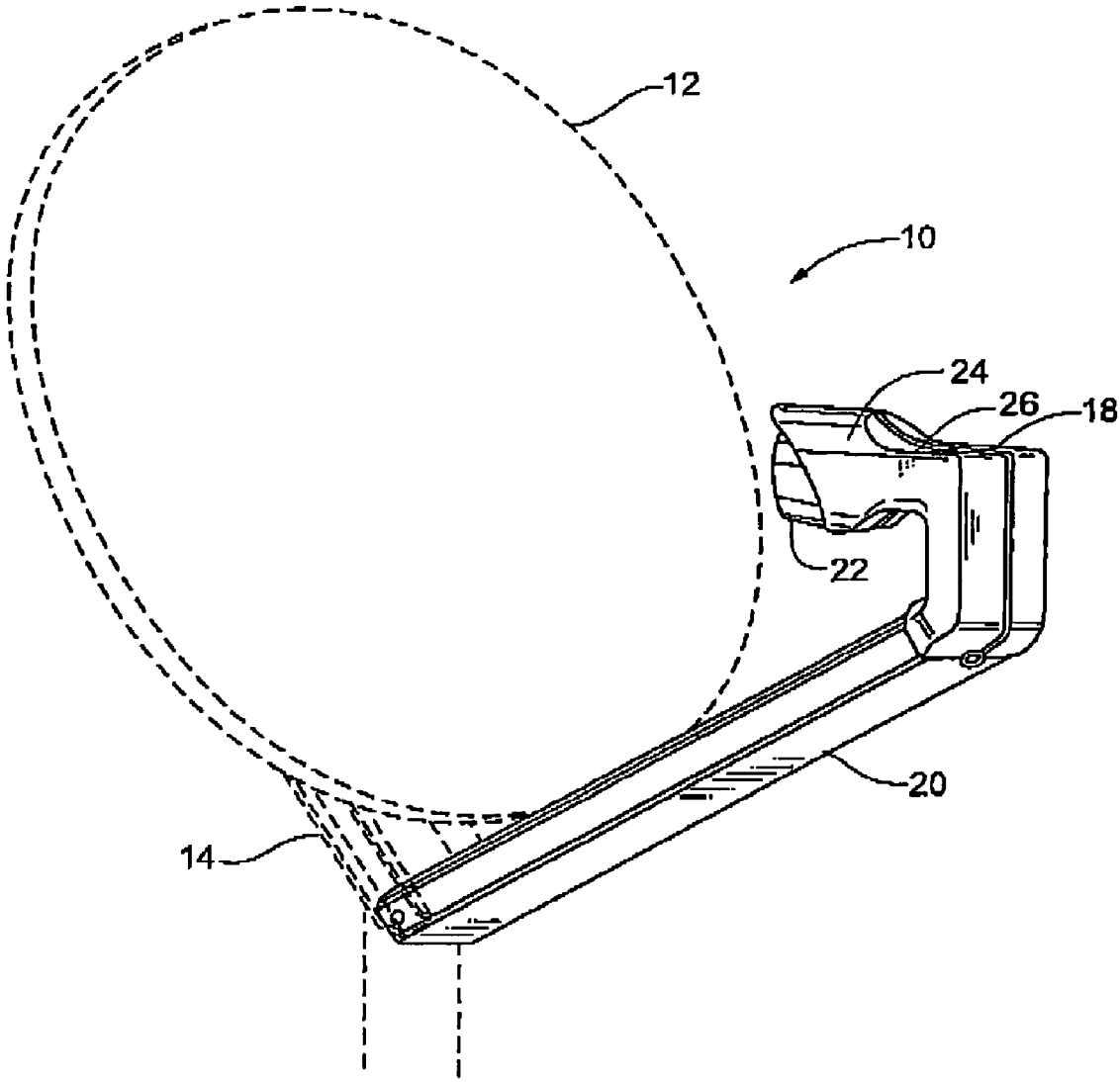
FIG. 1 is a perspective view of an uncovered small dish DBS satellite antenna system.

The present invention utilizes superhydrophobic materials and coatings to minimize the impact of water on the transmissivity of the satellite signal through transmissive surfaces in an antenna system. While theoretical calculations explaining the problems of rain fade are open to debate, the effect is real in that signal loss occurs.

The following table documents the results of using various commercially available compounds and techniques for addressing the rain fade problem simulated by spraying water onto a DBS antenna dish that was coated with the material.

TABLE 1

Prior Art Dome Coating Techniques

| Material | Signal Before water spray | Signal After water spray | Signal recovery after water spray | Rivulets and water film | Visual bubble velocity | Comments |
|---|---|---|---|---|---|---|
| Rain "X" ™ | 66 | 0 | Medium 1 min | Yes/no | Medium | Bubble size 3/16 ø to ≅1/64" ø |
| Bull Frog ™ | 59 | 0 | Very slow 5 min no signal | Yes/no | Slow | Bubble size 3/8" ø to ≅1/32" ø |
| Teflon ® | 66 | 0 | Medium 1 min | Yes/no | Medium | |
| Urethane Paint | 66 | 0 | Slow 3-6 min | Yes/no | Slow | Lost signal very quickly |
| Scotchgard ™ | 70 | 0 | Very slow Needed to be wiped | Yes/yes | Slow | The worst tested |
| 5- Star ™ | 68 | 0 | Fast 10 seconds | Yes/no | Medium | Easy to blow off bubbles comparatively quite good |
| Teflon oil | 69 | 0 | Medium | Yes/no | Medium | |
| Various polymer surfaces | Varied | 0 | Varied | — | Varied | None were close to satisfactory |

TABLE 1-continued

| Prior Art Dome Coating Techniques | | | | | |
|---|---|---|---|---|---|
| Material | Signal Before water spray | Signal After water spray | Signal recovery after water spray | Rivulets and water film | Visual bubble velocity Comments |
| Acrylic | 66 | 0 | Slow Needed to be wiped | Yes/yes | Slow |

In each case, the presence of water drops on the antenna system caused a complete signal loss, with different materials exhibiting different degrees of ability to recover from that signal loss. In no case, however, was consistent signal reception maintained during the test.

In order to prevent signal loss in the presence of moisture, the present invention utilizes materials that maximize the surface contact angle θ of the moisture drop with respect to transmissive surfaces of the antenna components. The antenna components with transmissive surfaces of most concern include the feed horn and any antenna shielding such as a dome. A surface contact angle θ greater than 120° reduces the moisture surface coverage of the respective antenna component. A surface contact angle θ greater than about 120° also encourages water drops to roll off the surface due to the reduction in surface contact of the base of the water drop. Moreover, it is believed that rivulets and "superdrops" (when multiple droplets combine) form when the base of a pair of droplets come into contact. By minimizing the base diameter of the individual water drops, the formation of rivulets or "superdrops" is also minimized, further reducing surface coverage. As a result of maximizing the surface contact angle θ, the moisture never reaches a critical coverage value that would block the signal.

In a first embodiment, the present invention is directed to improved reception of satellite signals for an uncovered antenna. For most uncovered small dish DBS satellite television antenna systems, the transmissive surface that has the largest impact on the reliability of satellite signal reception in moisture conditions is the feed horn cover. For a small dish DBS satellite television antenna system under a protective dome, the degradation of signal strength that occurs by virtue of the dome itself can be tolerated if the dome does not exacerbate consistent satellite signal reception in moisture conditions.

FIG. 1 illustrates a perspective view of an uncovered DBS satellite antenna system 10. The uncovered DBS satellite system 10 comprises a satellite dish 12 mounted by a support bracket 14 to a support 16. In this embodiment, the support bracket 14 is attached to a rear face of satellite dish 12. Support bracket 14 may be configured for adjusting the relative position of satellite dish 12, for example, by way of hinges or brackets to allow the user to aim the satellite dish 12 at the appropriate satellite. The satellite dish 12 is preferably shaped with a concave surface so that the front face of satellite dish 12 reflects incoming electromagnetic radiation to a focal point at a predetermined distance in front of the satellite dish 12.

While the preferred embodiment of DBS satellite antenna system 10 for a typical Ku band DBS satellite television system has been described, it will be understood that the present invention can be practiced on any number of various arrangements of satellite antenna dishes, mounting brackets and support arrangements as are known in the prior art for Ku band, Ka band or other satellite television or satellite information transmission and/or reception antenna systems, especially those antenna systems in which the diameter of the antenna are less than 60 inches in diameter and preferably less than 30 inches in diameter.

The satellite dish 12 directs incoming signals to a feed horn assembly 18 that is operably positioned at the focal point of the satellite dish 12. In this embodiment, the feed horn assembly 18 is disposed at a distal end of feed horn arm 20, with the proximal end of feed horn arm 20 attached to the mounting bracket 14. In this embodiment, the feed horn assembly 18 comprises a feed horn cover 22, a feed horn body 24 and a low noise block (LNB) signal converter 26. The LNB signal converter 26 is then connected by a coaxial cable (not shown) to a satellite receiver (not shown). It will be understood that the present invention can be utilized with any number of configurations for the feed horn assembly 18, including differing mounting arrangements, as well as single or multiple feed horn bodies 24, single or multiple feed horn covers 22 and single or multiple LNB signal converters 26.

In one embodiment that is well-known in the prior art, the feed horn cover 22 is a plastic cover that is snapped onto an end of the feed horn body 24 that is open at the focal point of the satellite dish 12. The materials and dimensions of the feed horn cover 22 are typically selected to minimize satellite signal loss through the feedhorn cover 22 during normal, non-moisture conditions.

As previously discussed, satellite signal quality degrades when moisture is present on the satellite antenna system 10. Rain, dew, sap, water rivulets, water film, or other debris can prevent satellite TV or other satellite signals in the 5-30 Giga Hertz range from being consistently received. Instead of trying to use a hydrophobic or superhydrophobic coating or material to shed water and similar materials from the satellite antenna dish as has been done in the past, this embodiment of the present invention utilizes superhydrophobic materials and/or coatings to minimize the impact of water on the transmissivity of the satellite signal through the feed horn cover 22.

Figure 2:
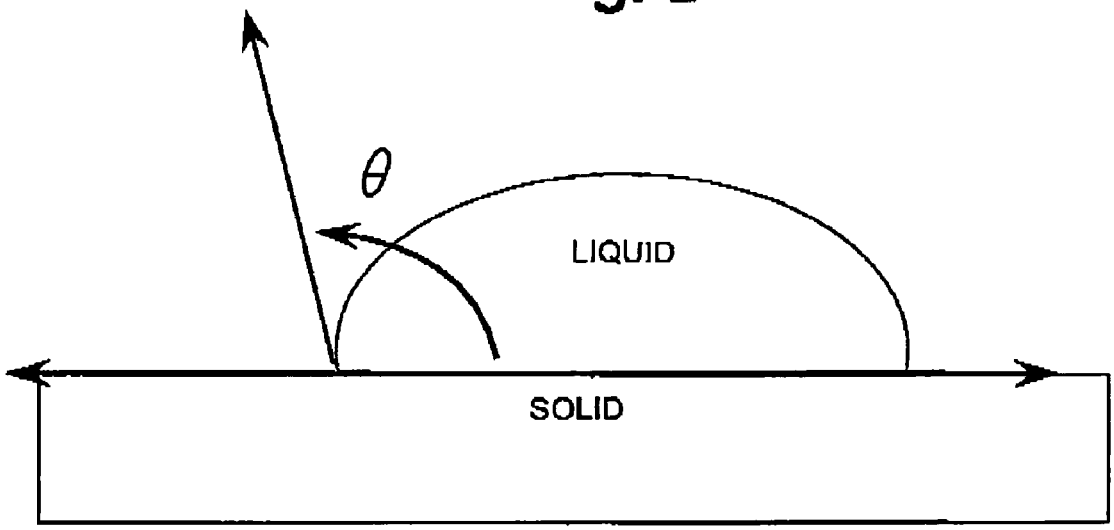
FIG. 2 is a side view of a water drop showing the measurement for static contact angle.

A superhydrophobic material is defined herein as one in which the static contact angle θ as illustrated in FIG. 2, of a water droplet is 120° or more relative to the surface on which the superhydrophobic material is applied. As illustrated in FIG. 2, the static contact angle θ is the angle created by the line tangent to the liquid drop that originates at the surface of the material. The static contact angle θ presented by example in FIG. 2 is less than 90°.

Figure 3:
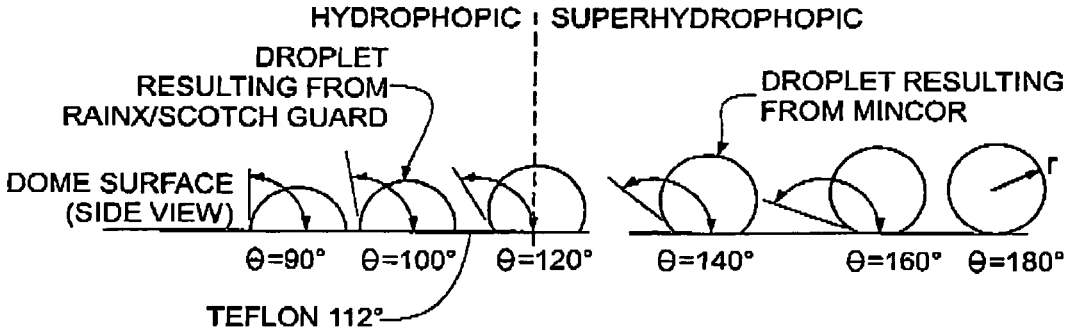
FIG. 3 is a side view of water drops at different static contact angles.

FIG. 3 illustrates how the static contact angle of water droplets varies in the presence of hydrophobic and superhydrophobic coatings. For example, a hydrophobic coating such as Scotchguard™ increases the static contact angle to approximately 100°-110° from the typical untreated surface. As superhydrophobic surfaces are applied, the static contact angle increases to at least 120° and can continue to increase until the static contact angle reaches a maximum at 180°.

Figure 4:
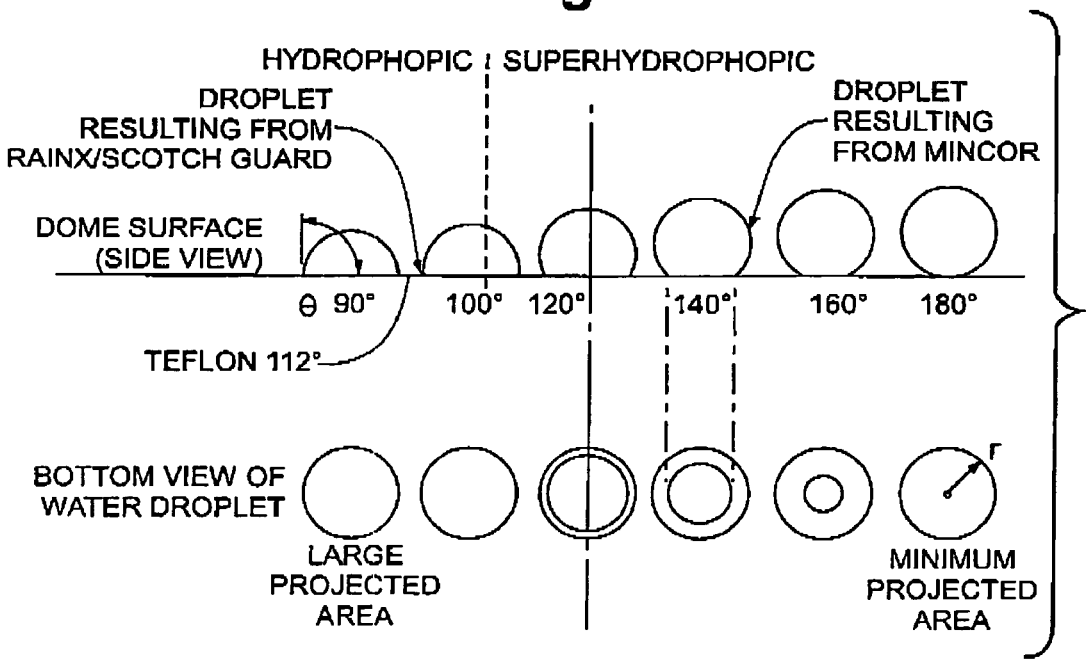
FIG. 4 is a top view of the effective electromagnetic shadow created by the water drops of FIG. 3.

FIG. 4 illustrates the advantage attained by applying superhydrophobic coatings to a transmissive surface in accordance with the present invention. Instead of trying to shed water from a reflective surface of the antenna system such as the parabolic dish, the present invention utilizes the superhydrophobic effect on a transmissive surface, i.e., a surface that the satellite microwaves pass through instead of being reflected, deflected and/or absorbed by the surface. In essence, the present invention reduces the diameter of the electromagnetic shadows created by those drops of water. Because shadows are not created by the reflection of an electromagnetic wave, reducing the amount of water on a reflective surface has only a limited effect on the overall performance of the satellite antenna.

For both hydrophobic and superhydrophobic materials having a static contact angle (θ), the area of the effective shadow cast by a drop of water having a radius ($r_1$) will be:

$$\text{Effective shadow}=\pi r_1^2(\text{Sin}\theta_c)^2.$$

Figure 10:
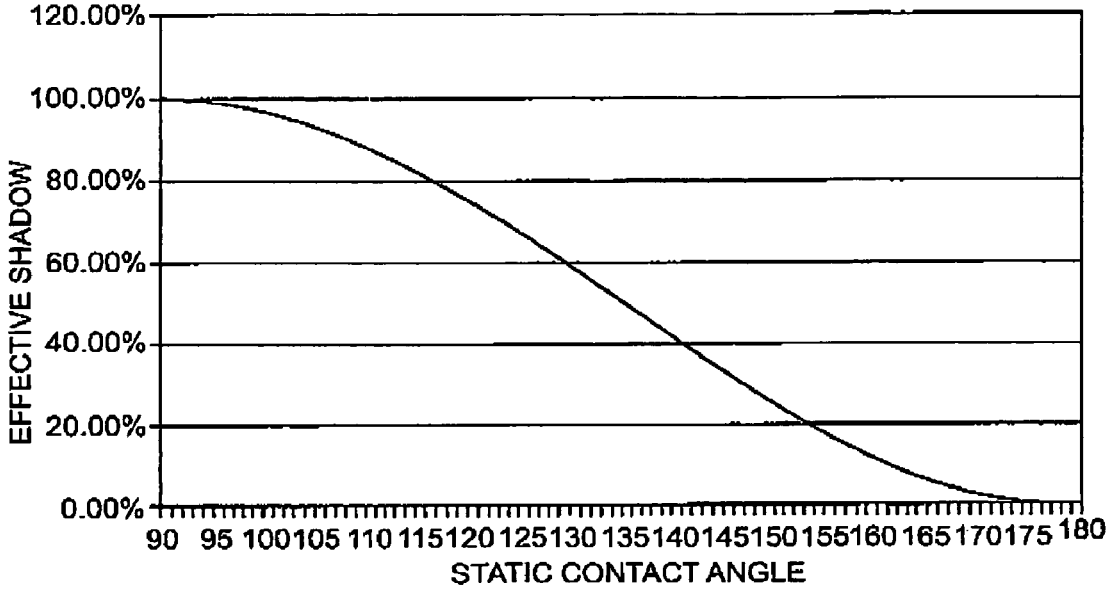
FIG. 10 is a graph of the relationship between the static contact angle (θ) and the effective shadow of a droplet of radius $r_1$.

Hydrophobic materials having static contact angles (θ) of less than about 110° will cast an effective shadow of 90-100% of the cross-sectional area of a drop of water. In contrast, superhydrophobic materials having a static contact angle (θ) of about 130° or greater will cast an effective shadow of less than about 60% of the cross-sectional area of a drop of water. FIG. 10 illustrates a graph of the relationship between the static contact angle (θ) and the effective shadow of a droplet of radius $r_1$.

FIGS. 5*a*, 5*b* and 5*c* illustrate the increase in performance due to application of superhydrophobic material to selected antenna surfaces. In one embodiment pursuant to U.S. Pat. No. 6,683,126, the superhydrophobic material is comprised of a finely divided powder whose particles have a hydrophobic surface and a porous structure characterized by a BET surface area of at least 1 $m^2/g$, and at least one film forming binder characterized by a surface tension of 50 mN/m. The weight ratio of the hydrophobic powder to binder should be at least 1:4. Preferably, this mixture can be further diluted for spreadability by addition of an organic solvent. In one embodiment, a dilution ratio of 1:12 ratio with an aromatic hydrocarbon solvent provided excellent coverage of the transmissive surfaces with consistent reception.

FIG. 5*a* shows results for an uncovered antenna system for Cases 1-4. As indicated in Case 1, water on the feed horn cover 22 essentially blocks the signal as compared to water on the dish 12 or water between the dish 12 and the feed horn assembly 18 (referred to in FIGS. 5*a*, 5*b* and 5*c* as the LNB) which can reduce and sometimes block the satellite signal. The present invention makes use of the realization that there is a critical path for satellite signal reception in moisture conditions that must address the issue of moisture on the feed horn cover 22. When only the reflector dish 12 is coated, as shown in Case 2, the signal measured at the LNB signal converter 24 still is blocked and registers 0 signal strength. Case 3 documents the results observed upon coating the feed horn cover 22 with a superhydrophobic material. Signal strength drops from 83 to 61-66 at the LNB signal converter 24. When both dish 12 and feed horn cover 22 are treated, as in Case 4, there is only marginal improvement in the LNB signal strength. The comparison of Case 3 and Case 4 demonstrates that coating the transmissive surface, in this case the feed horn cover 22, as taught by the present invention achieve consistency in satellite signal reception that simply have not been achieved by any other approaches.

FIG. 5*b* shows results from a shielded or shrouded embodiment of a satellite antenna system. These results as shown in FIG. 5*b* are further supported by side-by-side videotaped comparisons of picture quality during a heavy storm of a system without an untreated shielded antenna system versus a shielded antenna system coated with a superhydrophobic material. Both systems experienced a signal strength reading of 95 before the rain. Throughout the rainstorm the treated system never lost signal (Case 5), as the lowest reading was a signal strength of about 50. In comparison, the untreated shielded antenna system lost the signal for 40 minutes (Case 6).

FIG. 5*c* shows results from a domed embodiment of a satellite antenna system. The results in FIG. 5*c* show that both domes registered a signal strength of 74 prior to testing. In this case, the testing was conducted using a simulated rainfall system. In the treated domed system (Case 7), the signal strength reading was reduced to 51 at a lowest during the simulated rainfall testing. In the untreated domed system, the signal strength reading went to 0 during the simulated rainfall testing.

Figure 6:
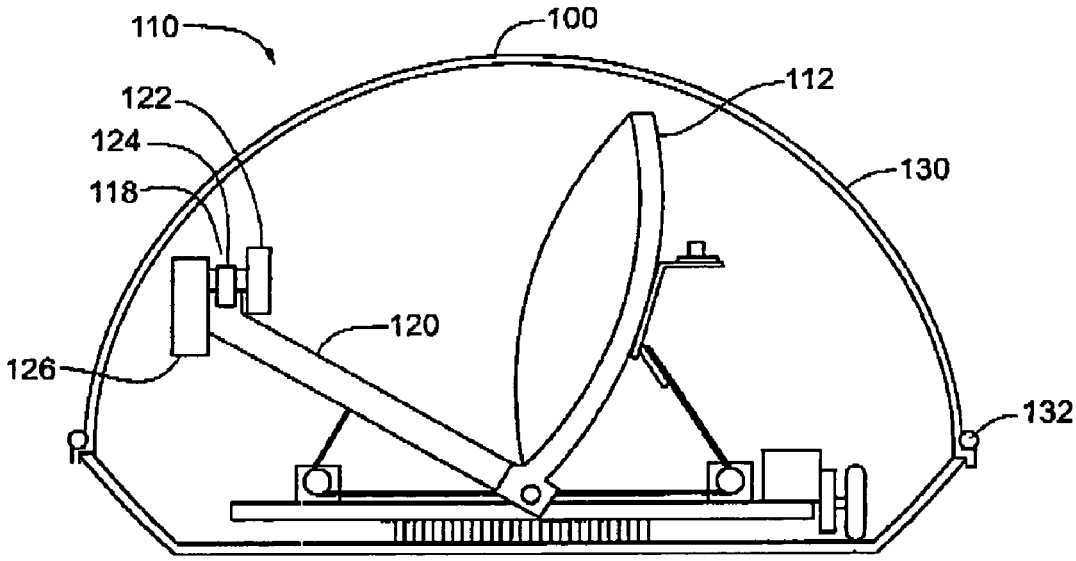
FIG. 6 is a cutaway perspective view of a small dish DBS satellite antenna system under a dome.

In an alternate embodiment as shown in FIG. 6, the use of a dome or a shield protects the antenna components from more than just moisture as they act as a shield from wind and debris as well. While a dome protects the entire antenna system, another embodiment protects only part of the antenna system with a hood or brim that protect the feed horn assembly 18 by shielding these components. As shown in FIG. 8, for example, a hood or brim 25 is attached so that the brim 25 maintains position relative to the feed horn assembly 18, while limiting any extension of a length of the brim 25 in a direction toward the dish 12 so as not to intersect a line from an edge of the antenna dish 12 to the feed horn cover 22. It will be understood that numerous variations can be made to the details of the manner in which such a hood or brim 25 are connected to or supported with respect to the antenna and to the extent of the shielding that could run from a simple brim over the LNB converter 24 to a much larger structure covering most of the antenna system, but not enclosing the antenna system as would a dome or radome.

In one embodiment of the present invention as shown in FIG. 6, consistent reception of signals for a satellite receiver is achieved by placing a dome 100 over a satellite antenna system 110. The satellite antenna system 110 includes a dish antenna 112 with a feed arm 120 extending distally toward a focal point where a feed horn assembly 118, including a low noise block (LNB) converter 126 and feed horn body 124 are located. In the embodiment shown in FIG. 6, the satellite antenna system 110 is rotatable about the vertical and horizontal axis to the extent necessary to direct the dish antenna at a satellite in geosynchronous orbit as described in more detail in U.S. Pat. No. 6,710,749, the disclosure of which is hereby incorporated by reference.

In the embodiment as shown in FIG. 6, the dome 100 is coated with a superhydrophobic material preferably in the form of a film material 130 that is stretched over and secured to the dome 100. In one embodiment, the film material 130 is a poly(tetraflouroethylene) (PTFE) film where the density of crystals in the film are decreased by axial extension of the film as described, for example, in "*Superhydrophobic PTFE Surfaces by Extension*," Macromol. Rapid. Commun., Vol. 25, pgs. 1105-1108 (2004), the disclosure of which is hereby incorporated by reference. In one version of this embodiment, the film material 130 is stretched over the dome 100 and secured by a ring arrangement 132 positioned at the base of the dome 100. Alternatively, the material of the dome 100 could be manufactured from a treated isotactic polypropylene material as described, for example, in "*Transformation of a Simple Plastic into a Superhydrophic Surface*," Science, Vol. 299, 1377-1379, (Feb. 28, 2004), the disclosure of which is hereby incorporated by reference.

Figure 11:
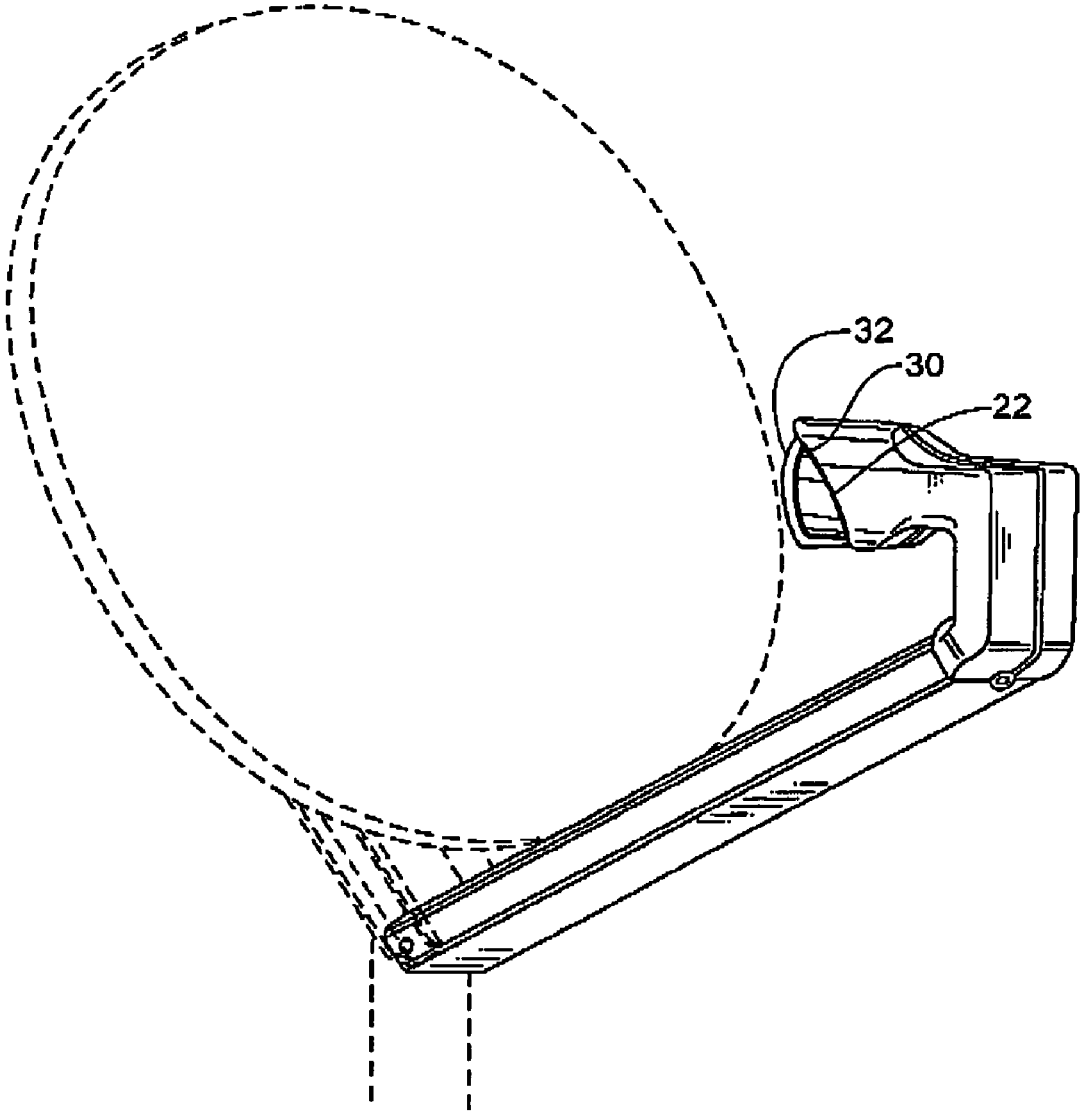
FIG. 11 is a perspective view of a feed horn with a film cover.

It will also be understood that the techniques of stretching a film material or altering the surface of a plastic material can be utilized to provide the superhydrophic coating/material for the feed horn cover 22. In one embodiment as shown in FIG. 11, the transmissive surface 30 of the feed horn cover 22 is a stretched PTFE film material 32 that is either extended over or completely replaces the typically more thicker transmissive portion of a conventional plastic feed horn cover. It should be understood that the present invention contemplates the coating, skinning, laminating or fabricating of a transmissive surface to establish a superhydrophobic surface for the transmissive surface of the antenna system.

Figure 7:
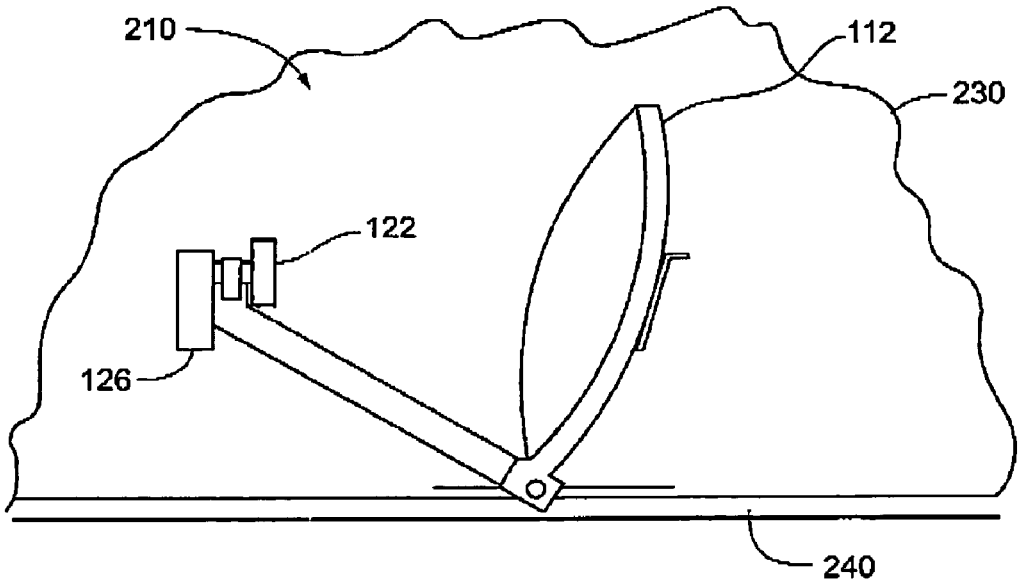
FIG. 7 is a cutaway perspective view of a small dish DBS satellite antenna system under a transmissive structure for a ground mount application.

In another embodiment, alternative transmissive structures other than a conventional dome can be used to protect the antenna system. For example, as illustrated in FIG. 7, a transmissive shell 230 is designed to simulate a landscape rock could be placed over a antenna system for a ground placement in areas where traditional wall mounting is inappropriate. The satellite antenna system 210 is anchored to the ground 240 while a hollow hemispherical landscape-like rock 230, coated with a superhydrophobic material, for example, is placed over the satellite antenna system 210 and likewise anchored.

The present invention also includes the method of improving reception of satellite signals by proper application of a superhydrophobic coating to critical structures of a satellite antenna system. As described above, the critical structures are first the transmissive structures and secondly the reflective structures. FIG. 9 illustrates the application of the superhydrophobic coating by a spray container 150 to feed horn cover 22 according to instruction sheet 152. In operation, the user would examine the instruction sheet 152 for proper application of the superhydrophobic coating 156. Proper application may vary based on the type of antenna system (i.e., dome covered or uncovered). Appropriate cleaning or other preparation of the transmissive surfaces to be sprayed is first directed by the instruction sheet. The instruction sheet would then inform the user as to the distance from the feed horn cover 22 to spray can 150, for example. Moreover, instruction sheet 152 may include the amount or duration of time spent applying superhydrophobic coating 156. Instruction sheet 152 may also include information as to the spray pattern for application or even the frequency of repeated applications that may be required. All of the instruction will depend upon the particular formulation of the superhydrophobic coating 156. Instruction sheet 152 may also contain instructions for coating the dish 12 or a dome as illustrated in FIG. 6.

The embodiments set forth herein describe particular components, but the scope of the invention is not limited to the particular examples set forth herein. For example, a variety of binders and types of powders can be used for the superhydrophobic material. Moreover, many types of diluting solvents may be used, as known to persons of skill in these arts.

What is claimed:

1. A satellite dish apparatus operably connectable to a satellite receiver, the satellite dish apparatus comprising:

a satellite antenna dish defining a focal point;

a feed horn assembly and a signal converter operably positioned relative to the focal point of the satellite antenna dish; and a superhydrophobic coating comprised of a binder solution and a powder dispersed therein, the coating applied directly to a transmissive surface of the feed horn assembly to form only a single layer.

2. The satellite dish apparatus of claim 1, further comprising:

a protective covering that extends over at least a portion of the satellite antenna dish and the feed horn assembly and is generally transparent to satellite signals, wherein the superhydrophobic coating is also applied to at least a transmissive portion of the protective covering.

3. The satellite dish apparatus of claim 2, wherein the protective covering is a dome extending over substantially all of the satellite antenna apparatus.

4. The satellite dish apparatus of claim 3, wherein the dome has an irregular shape.

5. The satellite dish apparatus of claim 4, wherein the irregular shape mimics an outward appearance of a boulder.

6. The satellite dish apparatus of claim 2, wherein the protective covering is a shroud, said shroud supported above the feed horn assembly and extending toward the antenna a distance beyond the transmissive portion of the feed horn assembly.

7. The satellite dish apparatus of claim 1, further comprising the superhydrophobic coating applied to at least a reflective portion of the satellite antenna dish.

8. The satellite dish apparatus of claim 1, wherein the superhydrophobic coating is sprayed onto the transmissive surface.

9. The satellite dish apparatus of claim 1, wherein the superhydrophobic coating forms a film layer adhered to the transmissive surface.

10. The satellite dish apparatus of claim 1, wherein the superhydrophobic coating forms a laminate on the transmissive surface.

11. The satellite dish apparatus of claim 1, wherein the superhydrophobic coating is added to the transmissive surface during manufacturing so as to impregnate an external face of the transmissive surface.

12. The satellite dish apparatus of claim 1, wherein the powder is finely divided and includes a plurality of nanoparticles with a hydrophobic surface and a porous structure characterized by a BET surface area of at least 1 $m^2/g$, and wherein said binder solution is characterized by a surface tension of 50 mN/m.

13. The satellite dish apparatus of claim 1, wherein the feed horn assembly includes a feed horn cover at least partially fabricated of a material that has a superhydrophobic surface utilized as a portion of a transmissive surface of the feed horn cover.

14. A direct broadcast satellite (DBS) television antenna system operably connectable to a satellite receiver, the DBS antenna system comprising:

a satellite antenna dish defining a focal point, the satellite antenna dish having a diameter of less than about 30" and being adapted to receive DBS satellite signals in the 5-30 GHz range; a feed horn assembly and a signal converter operably positioned relative to the focal point of the satellite antenna dish; and a single superhydrophobic coating comprised of a binder solution and a powder dispersed therein, the coating applied to a transmissive surface of the DBS antenna system to form only a single layer.

15. The DBS antenna system of claim 14, further comprising:

a protective covering that extends over at least a portion of the DBS antenna system and is generally transparent to satellite signals;

wherein the superhydrophobic coating is also applied to at least a transmissive portion of the protective covering.

16. A method for reliable satellite television reception in moisture conditions through a direct broadcast satellite (DBS) television antenna system operably connectable to a satellite receiver, said antenna system including a satellite antenna dish, the satellite antenna dish having a diameter of less than about 30" and being adapted to receive DBS satellite signals in the 5-30 GHz range, the method comprising:

directly coating a transmissive surface of the DBS antenna system with only a single non-separable layer of superhydrophobic coating comprised of a binder solution and a powder dispersed therein;

aiming the satellite antenna dish at a DBS satellite; and reapplying the coating directly to the transmissive portion of the DBS antenna system upon a loss of reception.

17. The method of claim 16, further including coating a protective covering that extends over at least a portion of the DBS antenna system and is generally transparent to satellite signals.

18. A kit for improving satellite television reception in moisture conditions through a direct broadcast satellite (DBS) television antenna system operably connectable to a satellite receiver, said antenna system including a satellite antenna dish, the satellite antenna dish having a diameter of less than about 30" and being adapted to receive DBS satellite signals in the 5-30 GHz range, the kit comprising:

a spray applicator, a superhydrophobic coating comprised of a binder solution and a powder dispersed therein contained within the spray applicator; and a set of instructions for applying the superhydrophobic coating directly on a transmissive surface of specific components of the direct broadcast satellite (DBS) television antenna system.

19. A replaceable feed horn cover for a satellite antenna system, said feed horn cover including a single non-separable layer of superhydrophobic coating comprised of a binder solution and a powder dispersed therein applied directly on a transmissive surface thereof to present a superhydrophobic surface for dispersion of moisture from the feed horn cover and structure that enables the feed horn cover to snap onto a feed horn body of the satellite antenna system.

20. The replaceable feed horn cover of claim 19, wherein the powder is finely divided and includes a plurality of nanoparticles with a hydrophobic surface and a porous structure characterized by a BET surface area of at least 1 $m^2/g$.

21. The replaceable feed horn cover of claim 19, wherein the superhydrophobic material is sprayed onto the transmissive surface of the feed horn cover.

22. The replaceable feed horn cover of claim 19, wherein the superhydrophobic material forms a film layer adhered to the transmissive surface of the feed horn cover.

23. The replaceable feed horn cover of claim 19, wherein the superhydrophobic material that is forms a laminate on the transmissive surface of the feed horn cover.

24. The replaceable feed horn cover of claim 19, wherein the superhydrophobic material forms at least a portion of the plastic material from which the transmissive surface of the feed horn cover is formed.

* * * * *